US009578973B1

(12) United States Patent
Kalista

(10) Patent No.: US 9,578,973 B1
(45) Date of Patent: Feb. 28, 2017

(54) CHILD SEAT FOR A SWIMMING POOL

(71) Applicant: Marie R. Kalista, Britton, MI (US)

(72) Inventor: Marie R. Kalista, Britton, MI (US)

( * ) Notice: Subject to any disclaimer, the term of this patent is extended or adjusted under 35 U.S.C. 154(b) by 92 days.

(21) Appl. No.: 14/563,399

(22) Filed: Dec. 8, 2014

Related U.S. Application Data

(60) Provisional application No. 61/977,865, filed on Apr. 10, 2014.

(51) Int. Cl.

| | |
|---|---|
| ***A47C 3/20*** | (2006.01) |
| ***A47C 15/00*** | (2006.01) |
| ***B63C 9/30*** | (2006.01) |
| ***E04H 4/14*** | (2006.01) |
| ***A47D 1/00*** | (2006.01) |
| ***A47C 7/66*** | (2006.01) |
| ***A47C 7/00*** | (2006.01) |
| ***A47C 3/34*** | (2006.01) |
| ***A47C 3/40*** | (2006.01) |

(52) U.S. Cl.

CPC ..... *A47C 15/006* (2013.01); *A47C 3/20* (2013.01); *A47C 3/34* (2013.01); *A47C 3/40* (2013.01); *A47C 7/002* (2013.01); *A47C 7/66* (2013.01); *A47D 1/004* (2013.01); *A47D 1/008* (2013.01); *B63C 9/30* (2013.01); *E04H 4/14* (2013.01)

(58) Field of Classification Search

CPC B63C 9/30; A47C 7/66; A47C 15/006; A47C 3/20; A47C 3/34; A47C 3/40; A47C 7/002; A47D 1/004; A47D 1/008; E04H 4/14

USPC ..... 441/129–132; 446/153

See application file for complete search history.

(56) References Cited

U.S. PATENT DOCUMENTS

| | | | | |
|---|---|---|---|---|
| 1,962,184 | A * | 6/1934 | Eiserman | A63B 35/00 472/13 |
| 2,720,249 | A * | 10/1955 | Peterson | A47C 9/10 108/141 |
| 2,938,726 | A * | 5/1960 | Hunter, Jr. | A63G 23/00 114/311 |
| 4,008,497 | A * | 2/1977 | Badon | E04H 4/065 4/487 |
| 4,799,910 | A | 1/1989 | Kellough | |
| 5,299,588 | A * | 4/1994 | MacLeod | A45B 11/00 135/16 |
| 5,505,645 | A * | 4/1996 | Engler, Jr. | A45B 23/00 135/16 |
| 5,823,121 | A * | 10/1998 | Reiter | A47B 37/00 108/147.19 |
| 5,993,276 | A | 11/1999 | Ponton et al. | |
| 6,126,504 | A | 10/2000 | Day | |
| 6,209,150 | B1 | 4/2001 | Hsu et al. | |
| 6,571,403 | B2 * | 6/2003 | Wheaton | E04H 12/2261 4/496 |
| 6,749,474 | B2 | 6/2004 | Hsu et al. | |

(Continued)

OTHER PUBLICATIONS http://www.swimways.com/infant-baby-pool-floats-c-40.aspx (May 30, 2013).

*Primary Examiner* — Ajay Vasudeva

(74) *Attorney, Agent, or Firm* — Robert C. Montgomery; Montgomery Patent & Design

(57) ABSTRACT

A child seat apparatus for use in a swimming pool includes a floatable seat assembly configured to support a child occupant upon a water surface, and a pedestal assembly removably connected to the seat assembly to support the seat assembly on a bottom of the swimming pool.

12 Claims, 4 Drawing Sheets

(56) References Cited

U.S. PATENT DOCUMENTS 7,293,840 B1 * 11/2007 Schu ..... B63C 9/30
297/448.2

7,887,383 B1 2/2011 Pott

* cited by examiner

CHILD SEAT FOR A SWIMMING POOL

RELATED APPLICATIONS

The present invention is a continuation-in-part of, was first described in, and claims the benefit of U.S. Provisional Application No. 61/977,865, filed Apr. 10, 2014, the entire disclosures of which are incorporated herein by reference.

FIELD OF THE INVENTION

The present invention relates generally to child seats and, more particularly, to a child seat configured for use in a swimming pool.

BACKGROUND OF THE INVENTION

Young children are delicate little beings that require the utmost care in order protect and keep them safe from harm. As a result, there are a myriad of products intended to provide protection from the danger generated by a variety of sources. Car seats protect them from physical harm while riding in a car, and sunshades shield their eyes and skin from the harmful effects of ultraviolet light. High chairs secure them at the dinner table, and barriers keep them from falling down stairs, and out of beds. The list goes on and on.

While there appears to be a product intended to protect infants from a seemingly endless list of dangers, one (1) learning experience they are not protected from is when they are in the water. Of course an adult or care provider can hold them, but then they are isolated from the water, and generally prohibited from playing in it. Additionally, the parent or care provider is then unable to help, care for, or assist other children who may be in the water as well.

Accordingly, there is a need for a means by which young children can be protected from harm when in any type of body of water, yet be afforded a playful and fun experience.

SUMMARY OF THE INVENTION

The inventor has recognized the aforementioned inherent problems and lack in the art and observed that there is a need for a child seat for swimming pools that provides increased safety for infants during water-based recreation. The development of the present invention, which will be described in greater detail herein, substantially departs from conventional solutions to fulfill this need.

In one (1) embodiment, the disclosed child seat apparatus for use in a swimming pool includes a floatable seat assembly configured to support a child occupant upon a water surface.

In another embodiment, the disclosed child seat apparatus for use in a swimming pool includes a floatable seat assembly configured to support a child occupant upon a water surface, and a pedestal assembly removably connected to the seat assembly to support the seat assembly on a bottom of the swimming pool.

In another embodiment of the disclosed child seat apparatus for use in a swimming pool, the seat assembly is pivotally connected to the pedestal assembly.

In another embodiment of the disclosed child seat apparatus for use in a swimming pool, the pedestal assembly is length adjustable.

In another embodiment of the disclosed child seat apparatus for use in a swimming pool, the seat assembly includes a floatation member, a seat frame connected to the floatation member, the seat frame defining a seat compartment, leg apertures extending from the seat compartment through the seat frame and the floatation member, a back rest connected to an upper end of a rear wall of the seat frame defining the seat compartment, an accessory tray connected to the seat frame and extending outwardly from the seat compartment, upper safety straps connected to the rear wall of the seat frame defining the seat compartment, and lower safety straps connected to a floor of the seat frame defining the seat compartment. The upper safety straps and the lower safety straps are releasably connected to secure the child occupant within the seat compartment.

In another embodiment of the disclosed child seat apparatus for use in a swimming pool, the pedestal assembly includes a weighted base in contact with the bottom of the swimming pool, the weighted base includes a filler material and anti-skid pads, a post receiver connected to the weighted base, a post insertably connected within the post receiver, and an upper frame connected to the post. The upper frame is removably connected to the seat assembly. The post is adjustably connected to the post receiver to adjust a vertical position of the seat assembly relative to the weighted base.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
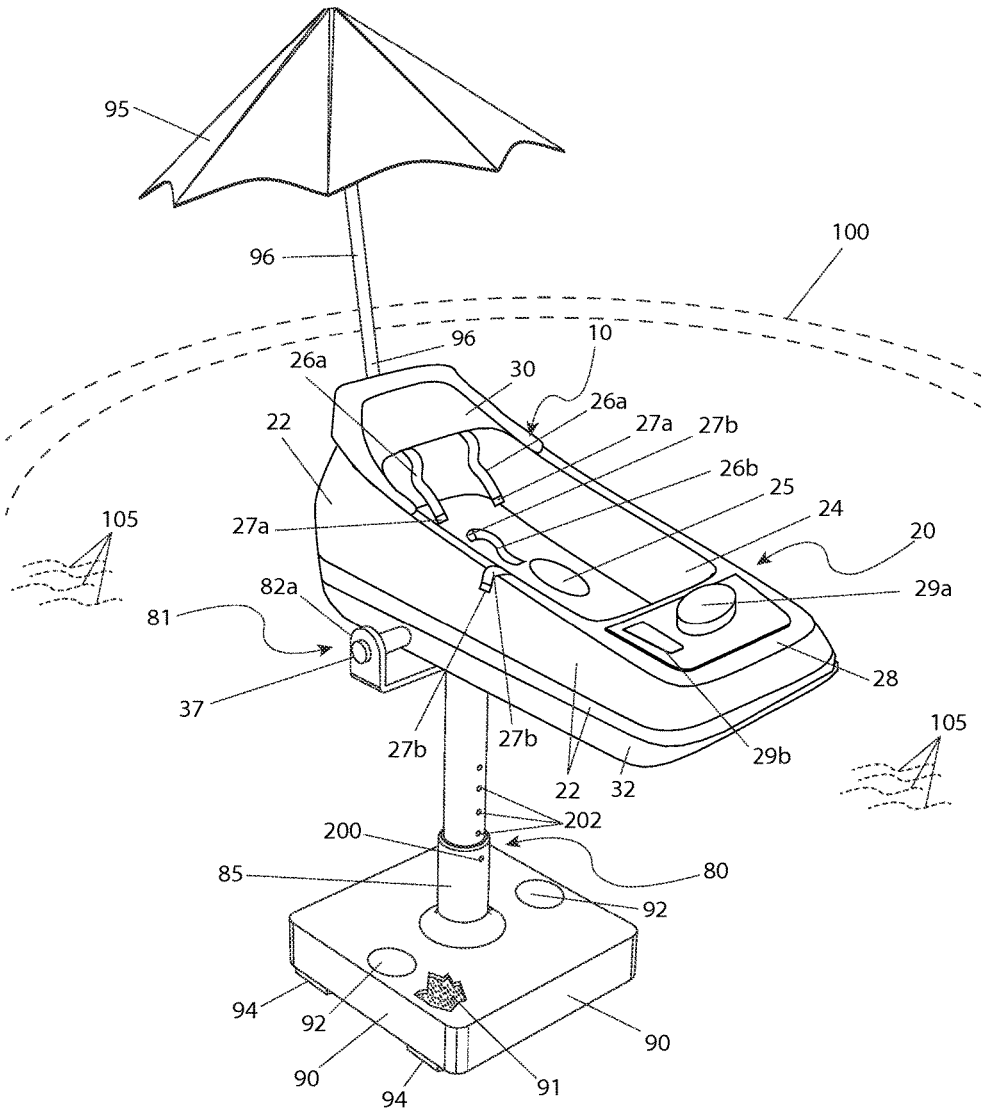
FIG. 1 is an environmental perspective view of the disclosed child seat for a swimming pool, according to one embodiment of the present invention.

10 child seat apparatus
20 seat assembly
22 seat frame
24 seat compartment
25 leg aperture
26*a* upper safety strap
26*b* lower safety strap
27*a* upper fastener
27*b* lower fastener
28 tray
29*a* first tray accessory
29*b* second tray accessory
30 padded backrest

32 flotation member
40 pivot rod
42 head
43 male threaded region
45 knob
46 female threaded region
64*a* first rod aperture
64*b* second rod aperture
80 pedestal assembly
81 upper frame
82*a* right-side frame member
82*b* left-side frame member
83 bottom frame member
84 post
85 post receiver
90 base
91 filler material
92 fill plug
94 anti-skid pad
95 umbrella
96 umbrella pole
97 umbrella aperture
100 swimming pool
105 water surface
200 threaded fastener
201 nut fastener
202 pedestal fastener aperture

DETAILED DESCRIPTION OF THE PREFERRED EMBODIMENT

In accordance with the invention, the best mode is presented in terms of a one or more of the disclosed embodiments, herein depicted within FIGS. 1 through 4. However, the disclosure is not limited to a single described embodiment and a person skilled in the art will appreciate that many other embodiments are possible without deviating from the basic concept of the disclosure and that any such work around will also fall under its scope.

Further, those skilled in the art will recognize that other styles and configurations can be incorporated into the teachings of the present disclosure, and that the example configurations shown and described herein are for the purpose of clarity and disclosure and not by way of limitation.

As used herein, the singular terms "a", "an", and "the" do not denote a limitation of quantity, but rather denote the presence of at least one (1), as well as a plurality of, the referenced items, unless the context clearly indicates otherwise.

As used herein, the terms "first", "second", "third", etc. are used as labels to describe various elements, features, and/or components, and are not intended to impose ordinal, positional, or hierarchical requirements on the referenced items, unless other indicated. For example, such terms may be used to distinguish one (1) element from another element.

As used herein, relative terms such as "front", "rear", "left", "right", "top", "bottom", "below", "above", "upper", "lower", "horizontal", or "vertical" are used to describe a relationship of one (1) element, feature and/or region to another element, feature and/or region as illustrated in the figures.

Referring to FIGS. 1-4, disclosing a child seat apparatus (herein described as the "apparatus") 10 for a swimming pool, where like reference numerals represent similar or like parts. Generally, the disclosed apparatus 10 provides a multipurpose stationary or floating restraint for an infant or child within a swimming pool 100 or similar environment.

Figure 3:
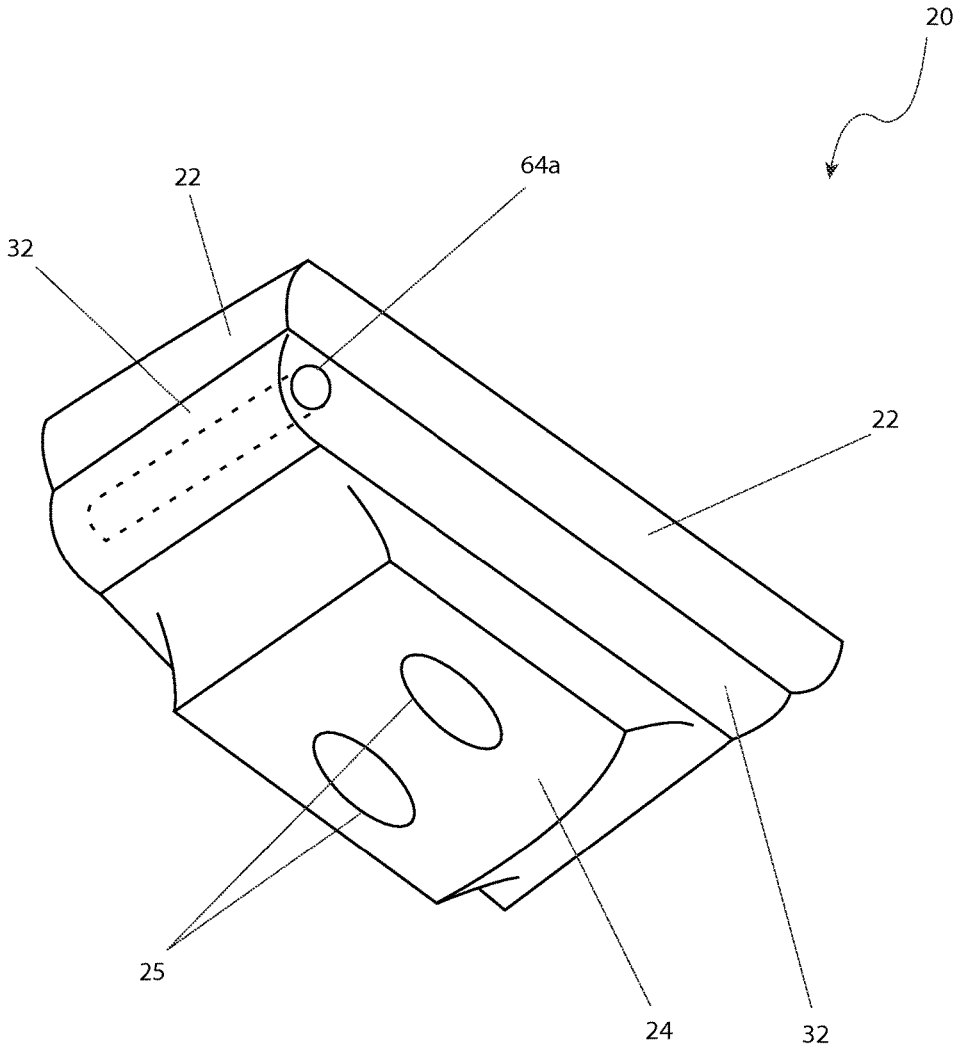
FIG. 3 is a bottom perspective view of a seat assembly of the disclosed child seat for a swimming pool, according to one embodiment of the present invention; and, FIG. 4 is a top and rear perspective view of the seat assembly and an umbrella of the disclosed child seat for a swimming pool, according to one embodiment of the present invention.
Figure 4:
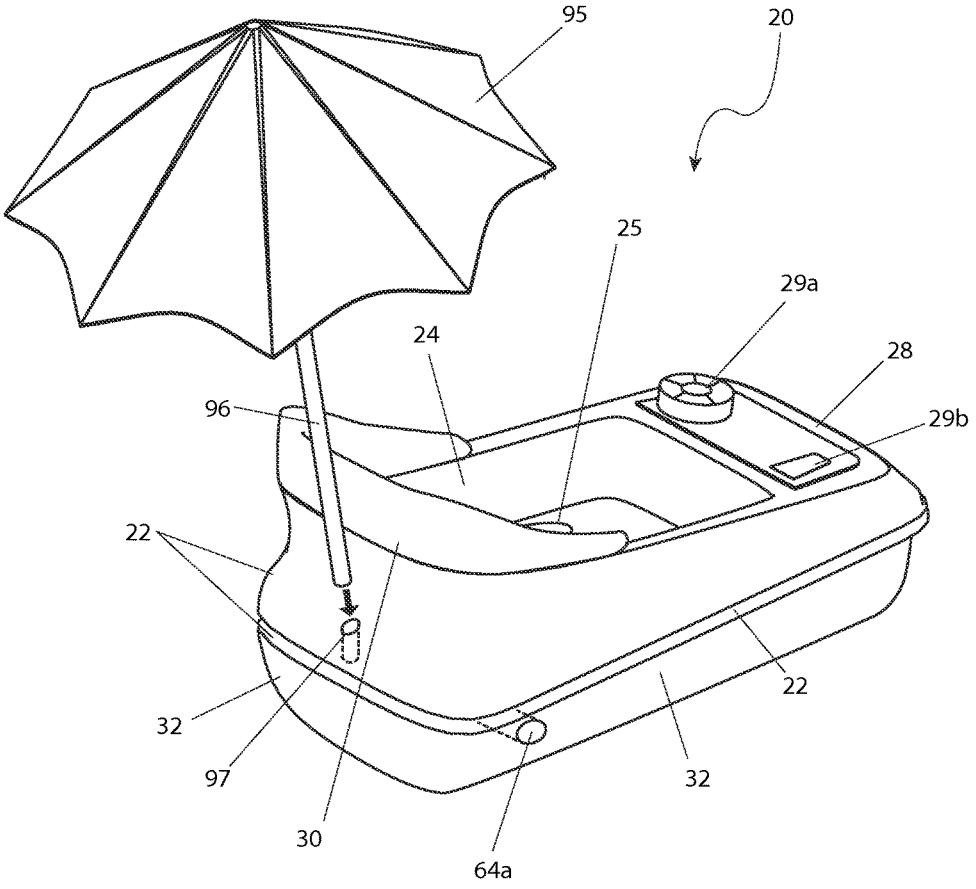

Referring now to FIGS. 1, 3 and 4, the apparatus 10 includes a child or infant seat assembly 20 adjustably supported upon a pedestal assembly 80. The pedestal assembly 80 is connected to or integral to a weighted base 90. The weighted base 90 rests 20 upon a bottom surface of the pool 100. The weighted base 90 stabilizes the pedestal assembly 80. The pedestal assembly 80 positions the seat assembly 20 upon a water surface 105 of the pool 100.

In various embodiment, the disclosed apparatus 10 can be used in both above-ground pools and in-ground pools. The pedestal assembly 80 and weighted base 90 securely positions the seat assembly 20 relative to the bottom surface of the pool 100. The pedestal assembly 80 supports the child seat assembly 20 and provides vertical adjustment to position the seat assembly 20 upon the water surface 105 within the swimming pool 100.

The apparatus 10 leaves both arms of a care-giver or parent free to attend to other tasks, or play with the child in the water. Furthermore, the seat assembly 20 may be detached from the frame assembly 80 and used as a stand-alone child floatation device, if desired.

The seat assembly 20 provides comfortable seated positioning of an infant occupant. The seat assembly 20 includes a wedge shaped molded plastic seat frame 22, which provides an attachment means to various safety, entertainment, and comfort features. In one example embodiment, the seat assembly 20 may include, but is not limited to, a textile-lined recessed seat compartment 24 having a pair of leg apertures 25, a padded backrest 30, a pair of upper safety straps 26*a*, a pair of lower safety straps 26*b*, and an accessory tray 28.

As one example construction, the backrest 30 is located on an upper rear edge of the seat frame 22. In one (1) example, the backrest 30 is a generally "U"-shaped foam rubber form having a waterproof covering. The seat compartment 24 is connected along a top perimeter edge to the seat frame 22 using a plurality of fasteners (not shown) such as rivets or the like. The safety straps 26*a*, 26*b* are envisioned to be made using durable strapping material. Each lower safety strap 26*b* is envisioned to be anchored to the seat compartment 24 so as to align with the infant's crotch area, and has a lower fastener 27*b* located at a distal end thereof. Each upper safety strap 26*a* is envisioned to be anchored along a rear edge of the seat compartment 24 and has an upper fastener 27*a* located at a distal end thereof.

The fasteners 27*a*, 27*b* are envisioned to be correspondingly mated together such that the straps 26*a*, 26*b* extend over the shoulder area of the occupant. It is understood that different models of the seat assembly 20 may be introduced having differently sized seat compartments 24 or different configurations of the straps 26*a*, 26*b* based upon a size of an occupying infant, and as such should not be interpreted as a limiting factor of the apparatus 10.

The tray 28 is integral to the seat frame 22 and extends in a forward direction having sufficient top surface area for arrangement of a plurality of infant entertaining features, for example, a first tray accessory 29*a* and a second tray accessory 29*b*.

The seat frame 22 also provides adhesive or equivalent attachment means to a subjacent flotation member 32 positioned along bottom outer perimeter edges. The flotation member 32 provides additional flotation and buoyant leveling of the seat assembly 20 upon the water surface 105 during use. The flotation member 32 is envisioned to have a round cross-section and to be made of a closed-cell plastic foam material.

The seat frame 22 also includes an integral umbrella aperture 97 along a top surface, which enables partial insertion of a handle pole 96 of an umbrella 95 to be used to provide shade to protect the infant occupant in the event of intense sunshine.

The seat assembly 20 includes a first rod aperture 64*a* formed laterally within a rear portion of the flotation member 32, which is removably connected to a corresponding pivot rod 40 of the pedestal assembly 80. The pedestal assembly 80 supports the child seat assembly 20 as well as provides vertical adjustment of the seat assembly 20 upon the water surface 105.

Figure 2:
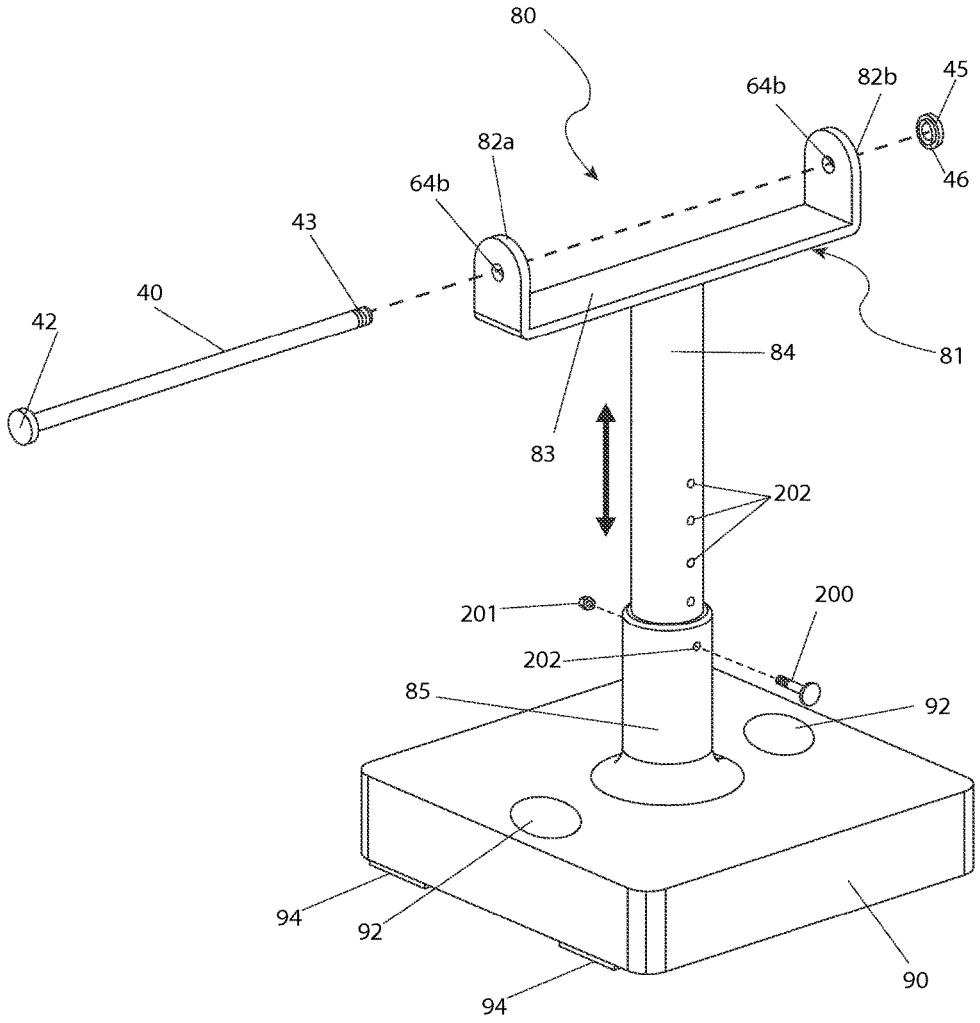
FIG. 2 is a partially exploded perspective view of a frame assembly of the disclosed child seat for a swimming pool, according to one embodiment of the present invention.

Referring to FIGS. 1 and 2, the base 90 is preferably a rigid hollow plastic enclosure having a generally rectangular perimeter shape with rounded corners and an integrally-molded cylindrical post receiver 85 centered upon and protruding upwardly from an upper surface portion of the base 90. The base 90 also includes at least one press-in fill plug 92 along a top exterior surface to enable filling and sealed containment of a volume of filler material 91.

The filler material 91 is envisioned to be a dense material such as, but not limited to, concrete, sand, gravel, and/or a sand and gravel mixture, or the like. It is envisioned that the base 90 provides a means to prevent skidding along a bottom surface of the swimming pool 100. In one (1) example embodiment, the base 90 includes a plurality of high-friction anti-skid pads 94 being adhesively bonded to or otherwise affixed along a bottom surface thereof. It is also envisioned that the base 90 may utilize additional means to establish a grip upon a bottom surface of the swimming pool 100 such as suction cups or other means, without limiting the scope of the apparatus 10.

The major portions of the apparatus 10 including the seat assembly 20, the pedestal assembly 80, and the base 90 are envisioned to be made of rugged, corrosion-resistant, waterproof plastic and textile materials, and introduced in various attractive colors and patterns based upon a user's preference.

Referring to FIG. 2, the pedestal assembly 80 supports the child seat assembly 20 as well as provides vertical adjustment of the seat assembly 20 upon the water surface 105 (FIG. 1). The pedestal assembly 80 is preferably made using injection-molded plastic portions forming an upper frame 81 and a height-adjustable post 84. The post 84 is receivably connected within the post receiver 85 of the base 90.

The upper frame 81 includes the interconnecting and removable pivot rod 40. The pivot rod 40 provides a means of pivotal attachment of the seat assembly 20 relative to the upper frame 81, thereby allowing the seat assembly 20 to partially float upon the water surface 105.

As illustrated in FIG. 4, the seat assembly 20 may be removed from the upper frame 81 to enable separate use of the seat assembly 20 by a care giver upon the water surface 105, if desired, while providing close supervision to the occupant. The seat assembly 20 provides removable attachment to the pivot rod 40 via a first rod aperture 64*a* (FIG. 3).

Referring to FIG. 2, the upper frame 81 includes a "U"-shaped form made up of parallel and opposing right-side frame member 82*a* and left-side frame member 82*b* being joined along bottom edges by a rectangular bottom frame member 83. The right-side 82*a* and left-side 82*b* frame members also include respective second rod apertures 64*b* at an intermediate height, which allow insertion of the pivot rod 40.

The pivot rod 40 is removably inserted into the first 64*a* and second 64*b* rod apertures of the upper frame 81 to provide removable pivot attachment of the seat assembly 20 (FIG. 1). The pivot rod 40 includes a linear plastic member having a round cross-sectional shape. The pivot rod 40 includes an integral cylindrical head 42 at one (1) end and a removably and threadingly attached knob 45 at an opposing end. The pivot rod 40 retains attachment of the knob 45 via engagement of respective male threaded region 43 and female threaded region 46. Removal of the pivot rod 40 and seat assembly 20 from the upper frame 81 is accomplished by removing the knob 45 and sliding the pivot rod 40 outwardly from the first 64*a* and second 64*b* rod apertures.

The integral cylindrical post 84 of the upper frame 81 is inserted into the subjacent and encompassing cylindrical post receiver 85 to provide a means of telescoping adjustment to provide positioning of the seat assembly 20 upon the water surface 105. The post 84 provides selectable and lockable height adjustment in relation to the post receiver 85 via a plurality of pedestal fastener apertures 202 formed or drilled through the post 84 and post receiver 85. By motioning the upper frame 81 and seat assembly 20 up and down, a desired height of the seat assembly 20 is obtained. The post 84 is then secured in position by aligning respective fastener apertures 202 and inserting a threaded fastener 200 through, and securing the threaded fastener 200 using a corresponding nut fastener 201.

Referring to FIG. 3, the seat assembly 20 includes the first rod aperture 64*a*, which allows insertion of the pivot rod 40 (FIGS. 1 and 2). The first rod aperture 64*a* is formed through the sidewalls of the flotation member 32, being sized to slidingly and rotatingly receive the pivot rod 40 therethrough. If desired, the seat assembly 20 may be removed from the pedestal assembly 80 for separate use upon the water surface 105. The rotational nature of the pivot rod 40 allows an occupying infant, seated within the seat compartment 24, to experience the up-and-down motion of the water surface 115 during use.

Referring to FIG. 4, the umbrella 95 provides shade and protection from direct sunlight to the occupant. The umbrella 95 includes a plastic or textile canopy with a downwardly extending plastic or wooden umbrella pole 96, which is removably inserted into the umbrella aperture 97, which is integrally-molded into a top rear surface of the seat frame 22. The umbrella aperture 97 has a cylindrical shape and is approximately three inches (3 in.) in depth. The umbrella aperture 96 is sized to form a snug fit around the umbrella pole 96 when inserted.

Those skilled in the art will recognize that other styles and configurations of the disclosed apparatus 10 can be easily incorporated into the teachings of the present disclosure, and only particular configurations have been shown and described for purposes of clarity and disclosure and not by way of limitation of scope.

The example embodiments of the disclosed apparatus 10 can be utilized by the user in a simple and effortless manner with little or no training. After initial purchase or acquisition of the apparatus 10, it would be utilized as indicated in FIGS. 1 and 4.

One embodiment of the disclosed method for installing and/or utilizing the apparatus 10 can include a series of steps, including: 1). procuring a model of the apparatus 10 having a desired color and aesthetic appearance; 2). filling the base 90 with the filler material 91 by removing the fill plugs 92 and adding a volume of filler material 91, such as sand, into the base 90; 3). replacing the fill plugs 92; 4). attaching the seat frame 22 to the pedestal assembly 80, if not previously connected, by inserting the pivot rod 40 through the first 64*a* and second 64*b* rod apertures of respective seat assembly 20 and upper frame 81; 5). replacing the knob 45 by threadingly engaging the male threaded region 43 and female threaded region 46 of respective pivot rod 40 and knob 45, and tightening; 6). submerging the base

90 below the water surface 105 of the swimming pool 100 until the anti-skid pads 94 of the base 90 contact the bottom surface of the swimming pool 100; 7). adjusting a height of the seat assembly 20 upon the water surface 105 by motioning the upper frame 81 and seat assembly 20 up and down to obtain a desired height of the seat assembly 20; 8). securing the post 84 in position by aligning respective fastener apertures 202 and inserting a threaded fastener 200; 9). securing the threaded fastener 200 using a corresponding nut fastener 201; 10). placing an infant into the seat compartment 24 and inserting legs of the infant through the leg apertures 25; 11). allowing the infant to recline against the padded backrest 30; 12). securing the infant within the seat compartment 24 by fastening the lower straps 26*b* to the upper straps 26*a* together on both sides of the infant using the fasteners 27*a*, 27*b*; and 13). installing the umbrella 95, if needed or desired, based upon an amount of ambient sunlight, by inserting an umbrella pole 96 into the umbrella aperture 97 of the seat frame 22.

Accordingly, a user of the disclosed apparatus 10 benefits from available use of both arms to attend to other tasks or to play with the occupying infant in the water.

Another embodiment of the disclosed method for installing and/or utilizing the apparatus 10 as a floating vessel upon the water surface 105 (e.g., separate from the pedestal assembly 80) can include a series of steps, including: 1). removing the knob 45 from the pivot rod 40; 2). sliding the pivot rod 40 outwardly from the first 64*a* and second 64*b* rod apertures; 3). removing the seat assembly 20; 4). placing the seat assembly 20 upon the water surface 105; 5). placing an occupant within the seat compartment 24; 6). securing the occupant by fastening the straps 26*a*, 26*a* together; and 7). utilizing the seat assembly 20 and flotation member 32 of the apparatus 10 to support the occupant upon the water surface 105 while a care giver provides close supervision.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A child seat apparatus for use in a swimming pool, said apparatus comprising:

a floatable seat assembly configured to support a child occupant upon a water surface, comprising:

a flotation member;

a seat frame connected to said flotation member, said seat frame defining a seat compartment;

leg apertures extending from said seat compartment through said seat frame and said flotation member;

a back rest connected to an upper end of a rear wall of said seat frame defining said seat compartment;

an accessory tray connected to said seat frame and extending outwardly from said seat compartment;

upper safety straps connected to said rear wall of said seat frame defining said seat compartment; and, lower safety straps connected to a floor of said seat frame defining said seat compartment;

wherein said upper safety straps and said lower safety straps are releasably connected to secure said child occupant within said seat compartment; and, a pedestal assembly removably connected to said seat assembly to support said seat assembly on a bottom of said swimming pool.

2. The apparatus of claim 1, wherein said seat assembly is pivotally connected to said pedestal assembly, and wherein said pedestal assembly comprises a weighted base in contact with said bottom of said swimming pool.

3. The apparatus of claim 2, further comprising an umbrella removably connected to said seat assembly.

4. The apparatus of claim 2, wherein said pedestal assembly is length adjustable.

5. The apparatus of claim 2, wherein said weighted base comprises a filler material comprising a density greater than water.

6. The apparatus of claim 5, wherein said filler material comprises at least one of concrete, sand, and gravel.

7. The apparatus of claim 2, wherein said weighted base comprises anti-skid pads.

8. The apparatus of claim 2, wherein said pedestal assembly further comprises a post interconnecting said seat assembly and said weighted base.

9. The apparatus of claim 8, wherein said pedestal assembly further comprises a post receiver connected to said weighted base, and wherein said post is insertably connected with said post receiver.

10. The apparatus of claim 9, wherein said post is adjustably connected to said post receiver to adjust a vertical position of said seat assembly relative to said weighted base.

11. The apparatus of claim 8, wherein said post comprises:

an upper frame configured to partially receive said seat assembly; and, a pivot rod extending through said seat assembly and rotatably connected to said upper frame.

12. The apparatus of claim 11, wherein said seat assembly further comprises a rod aperture extending completely through said flotation member, wherein said pivot rod extends through said rod aperture and rotatably connects to said upper frame.

* * * * *